United States Patent [19]

Otten et al.

[11] 3,996,889

[45] Dec. 14, 1976

[54] APPARATUS FOR COATING WEB-FORM SUBSTRATES WITH LIQUID SOLUTION OR DISPERSIONS

[75] Inventors: Horst Otten; Hans Frenken, both of Leverkusen; Heinrich Bussmann, Opladen; Karl Voss, Leverkusen, all of Germany

[73] Assignee: AGFA-Gevaert, A.G., Leverkusen, Germany

[22] Filed: Apr. 7, 1975

[21] Appl. No.: 565,346

[30] Foreign Application Priority Data

Apr. 11, 1974 Germany ..... 2417720

[52] U.S. Cl. ..... 118/126; 118/413

[51] Int. Cl.[2] ..... B05C 11/04

[58] Field of Search ..... 118/50, 126, 123, 413, 118/119

[56] References Cited

UNITED STATES PATENTS

| | | | |
|---|---|---|---|
| 3,363,603 | 1/1968 | Hill | 118/126 |
| 3,486,482 | 12/1969 | Hunger | 118/126 X |
| 3,690,917 | 9/1972 | Herzhoff et al. | 118/50 X |
| 3,695,218 | 10/1972 | Herzhoff et al. | 118/50 |

*Primary Examiner*—John P. McIntosh

*Attorney, Agent, or Firm*—Connolly and Hutz

[57] ABSTRACT

An apparatus is provided for coating web-form substrates, the apparatus consisting of a coating roller and of a coating block part of which is pivotal. The thickness of the layer coated on the substrate is determined by the interval between the coating block and the coating roller. In order to adjust this interval, to the precise value needed replaceable precision-gauge blocks corresponding in length to the required production conditions are arranged between the fixed part and the pivotal part of the coating block.

3 Claims, 2 Drawing Figures

APPARATUS FOR COATING WEB-FORM SUBSTRATES WITH LIQUID SOLUTION OR DISPERSIONS

This invention relates to an apparatus for coating web-form substrates with liquid solutions or dispersions, and is particularly applicable to the coating of substrates with photographic emulsions. Apparatuses of this kind generally include a coating roller and a coating block part of which is pivotal. The thickness of the layer of solution or dispersion applied is predetermined to the desired value by adjusting the interval between the coating block and the coating roller.

This interval as to be readjusted every time there is a change in the substrate or in the coating liquid. When dealing with photographic emulsions, readjustment of the interval is particularly necessary when the chemical composition of the emulsion, the layer thickness to be applied or the viscosity of the emulsion are changed. The interval has to be adjusted with a high degree of accuracy, in fact within tolerances of ± 0.002 mm.

An object of the present invention is to provide a suitable means of obtaining a more precise and reproducible adjustment of the interval to suit the particular conditions.

According to the invention there is provided an apparatus for coating substrate webs with a liquid, comprising a coating roller; a coating block having a fixed section and a pivotal section, the position of the pivotal section determining the final thickness of the layer of liquid with which the web is coated; and a replaceable precision-gauge block received between the fixed and pivotal sections of the coating block to determine the position of the said pivotal section.

In this way, the requisite interval *a* between the coating edge and the web can be accurately adjusted and, once adjusted, does not change even during operation. Furthermore, there is no danger of the coating edge being damaged because the precision-gauge blocks form stops so that the coating edge can never be swung down on to the coating roller. Another significant advantage of the invention is that the critical interval *a* can be adjusted quickly and easily. There is no need for any further adjustment work.

Figure 1:
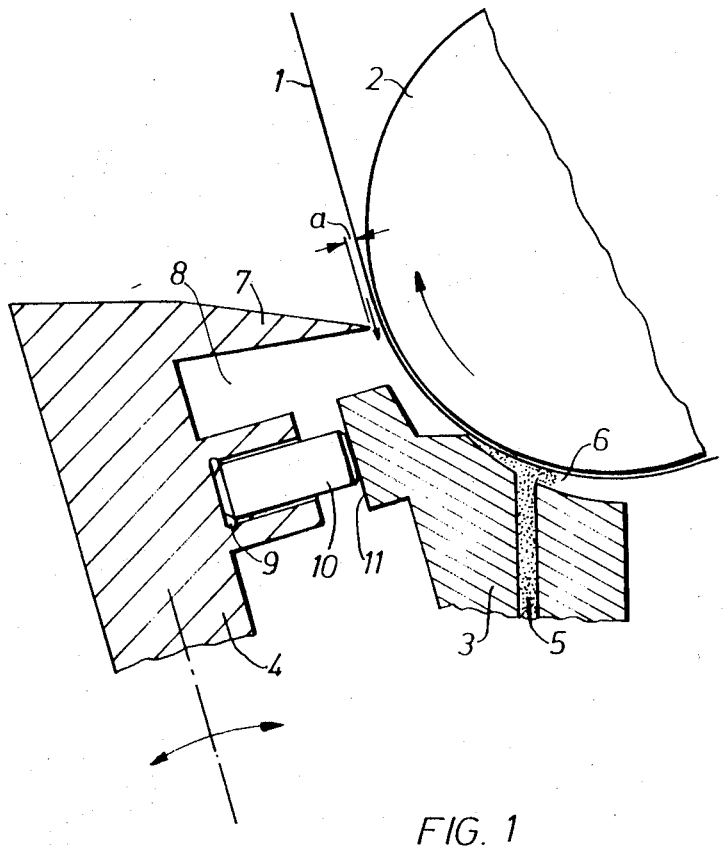
FIG. 1 is a section through an embodiment of the invention.

As shown in FIG. 1 a web in the form of a film or paper substrate 1 to be coated is guided over a coating roller 2 which rotates in the direction of the arrow. A coating block is provided which consists of a fixed section 3 and a pivotal section 4. The web 1 is coated with photographic emulsion 5 in a V-shaped gap 6 defined between the web and the fixed section 3 of the coating block. A coating edge defining member 7 is arranged downstream of the gap 6. The member 7 has a front sharp coating edge which extends strictly parallel to the surface of the web and pependicularly of its direction of travel. In this case, the interval *a* between the above mentioned coating edge 7 and the web 1 critically determines the final thickness of the layer coated on the web 1. A space 8 is connected to a vacuum pump so that reduced pressure prevails there. This causes an air stream to flow tangentially to the web 1 in a direction opposite to the direction of web travel in the gap between the coating edge and the web 1.

As already mentioned, the upper section 4 of the coating block, including the coating edge, is pivotally mounted. In order to be able to adjust the interval *a* accurately and reproducibly, the pivotal section 4 of the coating block is provided with a pocket 9 into which precision-gauge blocks 10 are inserted. Pivotal movement of the section 4 of the coating block is limited by the contact of the precision gauge block 10 with an anvil surface 11 of the fixed section 6 of the coating block. In practice, a set of precision gauge blocks 10 will be made up. When coating conditions change, necessitating a change in the interval *a*, all that is necessary is to replace the precision gauge block 10 accommodated in the pocket 9. This simplification in the adjustment of the critical interval *a* provides for considerable rationalisation and may even be carried out by less skilled labour.

The invention has been described with reference to a coating apparatus of the type described in detail, for example in German Patent Specification 1,577,722 (U.S. Pat. No. 3,635,198) or German Offenlegungsschrift 2,235,781. However, the invention is by no means limited to a coating apparatus of this type, and may be used successfully in any type of coating apparatus where the final thickness of the coating layer is determined by a pivotal section of the apparatus.

Figure 2:
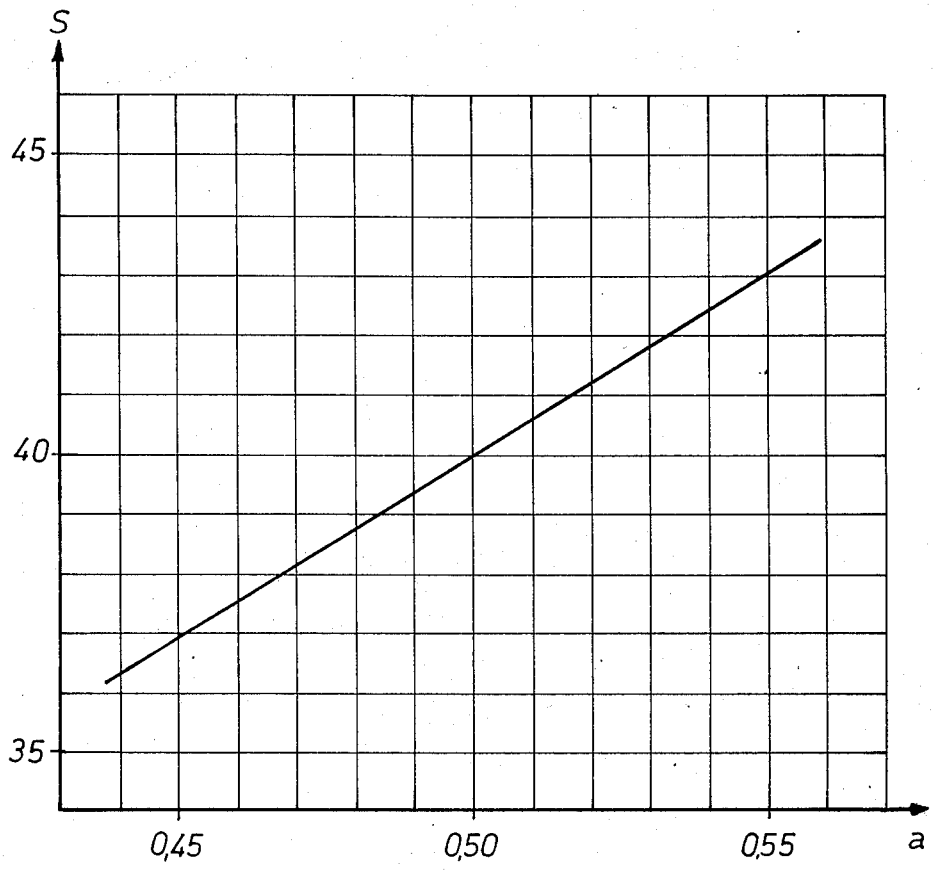
FIG. 2 is a graph showing the relationship between the distance from the coating edge to the coating roller and the thickness of the layer of liquid with which the substrate is coated.

FIG. 2 shows the final thickness S of the coating on the web as a function of the distance *a* between the coating edge and the web. S is expressed in microns and *a* in mm. In this example the viscosity of the coating liquid was 7cP, the pressure in the chamber 8 was 9.2 torr below atmospheric, and the web was travelling at speed of 60 m/min. It will be seen that S varies linearly with *a*.

What we claim is:

1. An apparatus for coating substrate webs with a liquid, comprising a coating roller; a coating block having a fixed section and a pivotal section adjacent the periphency of the coating roller, the position of the pivotal section relative to the periphery of the coating roller determining the final thickness of the layer of liquid with which the web is coated, a pocket in one of the coating block sections having an opening disposed toward the other section, a replaceable precision-gauge block having flat smooth contacting faces received in the pocket and disposed in contact between the fixed and pivotal sections of the coating block to determine the position of the said pivotal section whereby replacement of the gauge block for precisely determining different coating thicknesses is facilitated.

2. An apparatus as set forth in claim 1 wherein the pivotal section has a sharp-edged coating defining member disposed in front of the coating block.

3. An apparatus as set forth in claim 2 wherein the pivotal section incorporates a smooth-sided pocket within which the replaceable precision gauge block is disposed.

* * * * *